United States Patent [19]

Date et al.

[11] 4,375,958

[45] Mar. 8, 1983

[54] METHOD FOR PREHEATING STEEL SCRAP BY EXHAUST GAS FROM STEELMAKING ELECTRIC FURNACE

[75] Inventors: Takasaburo Date, Yokohama; Toshimichi Maki, Tokyo; Mitsuya Iguchi, Himeji; Sumifusa Iwamaru, Himeji; Hisashi Watanabe, Himeji, all of Japan

[73] Assignees: Nippon Kokan Kabushiki Kaisha; Toshin Seiko Kabushiki Kaisha, both of Tokyo, Japan

[21] Appl. No.: 268,797

[22] Filed: Jun. 1, 1981

[30] Foreign Application Priority Data

Jun. 6, 1980 [JP] Japan ..... 55-76315
Aug. 29, 1980 [JP] Japan ..... 55-119533

[51] Int. Cl.[3] ..... F27D 3/00; F27D 17/00

[52] U.S. Cl. ..... 432/9; 266/157; 373/80; 432/28; 432/72

[58] Field of Search ..... 432/9, 28, 72, 179; 13/33; 266/144, 145, 156; 373/80

[56] References Cited

U.S. PATENT DOCUMENTS 3,163,520 12/1964 Collin et al. ..... 266/156
3,876,418 4/1975 Baum ..... 13/33
3,936,588 2/1976 Asphaug et al. ..... 13/33

FOREIGN PATENT DOCUMENTS 1124806 8/1968 United Kingdom .
1484420 9/1977 United Kingdom .
1508935 4/1978 United Kingdom .
2005389 4/1979 United Kingdom .
2025589 1/1980 United Kingdom .

*Primary Examiner*—John J. Camby
*Attorney, Agent, or Firm*—Frishauf, Holtz, Goodman and Woodward

[57] ABSTRACT

A method for preheating steel scrap by an exhaust gas from a steelmaking electric furnace, which comprises: directing, when manufacturing steel from steel scrap in an electric furnace, an exhaust gas produced in said electric furnace to an exhaust gas combustion chamber provided in the middle of a discharge duct of said exhaust gas to cause combustion of carbon monoxide contained in said exhaust gas to form a combustion exhaust gas; and selectively directing part of said combustion exhaust gas into at least one scrap preheating chamber provided in the middle of a branch duct branching off from said discharge duct to preheat steel scrap charged in said scrap preheating chamber to a prescribed temperature; said method being characterized by: feeding back all of said combustion exhaust gas after preheating said steel scrap charged in said scrap preheating chamber to said exhaust gas combustion chamber to cause combustion of an incomplete-combustion gas which is produced by the incomplete combustion of combustible substances entrapped in said steel scrap and which is contained in said combustion exhaust gas.

6 Claims, 4 Drawing Figures

METHOD FOR PREHEATING STEEL SCRAP BY EXHAUST GAS FROM STEELMAKING ELECTRIC FURNACE

FIELD OF THE INVENTION

The present invention relates to a method for preheating steel scrap by using an exhaust gas produced in a steelmaking electric furnace, which permits, when manufacturing steel from the steel scrap in the electric furnace, efficient preheating of the steel scrap to a prescribed temperature without causing any pollution problem, with the use of the exhaust gas produced in the electric furnace.

BACKGROUND OF THE INVENTION

A method is known, which comprises, when manufacturing steel from steel scrap in an electric furnace, preheating the steel scrap by using a high-temperature exhaust gas produced in the electric furnace, and charging the steel scrap thus preheated into the electric furnace for refining. According to this method, it is possible to reduce the refining time in the electric furnace, and to save the electric power consumption required for refining.

FIG. 1 is a schematic drawing illustrating an embodiment of the conventional method for preheating steel scrap by an exhaust gas from a steelmaking electric furnace. In FIG. 1, 1 is an electric furnace; 2 is a discharging duct of an exhaust gas produced in the electric furnace 1; 4 is an exhaust gas combustion chamber provided in the middle of the discharge duct 2; and, 6 is a scrap preheating chamber provided in the middle of a branch duct 7 branching off from the discharge duct 2. When manufacturing steel from steel scrap in the electric furnace 1, an exhaust gas produced in the electric furnace 1 is discharged through an exhaust duct 5 provided in the furnace lid of the electric furnace 1, and directed to the exhaust gas combustion chamber 4 provided in the middle of the discharge duct 2 together with air in an appropriate amount sucked from a gap 3 having an adjustable opening provided at an end of the exhaust duct 5 to cause combustion of carbon monoxide contained in the exhaust gas and thus to form a combustion exhaust gas.

The combustion exhaust gas is directed to a scrap preheating chamber 6 provided in the middle of the branch duct 7 branching off from the exhaust duct 2, and preheats the steel scrap charged in the scrap preheating chamber 6 to a prescribed temperature. The combustion exhaust gas after preheating the steel scrap is discharged to the open air from a chimney 11 through a cooling chamber 8 and a dust collector 9 provided on the discharge duct 2. 10 is a fan provided in the middle of the discharge duct 2; 14 is another fan provided in the middle of the branch duct 7; and, 12 and 13 are dampers.

FIG. 2 is a schematic drawing illustrating another embodiment of the conventional method for preheating steel scrap. In this embodiment, two scrap preheating chambers 6 and 6' are provided in parallel with each other in the middle of the branch duct 7 branching off from the discharge duct 2; dampers 12 and 12' are provided on the branch duct 7 on the combustion exhaust gas entry side of the scrap preheating chambers 6 and 6'; and, dampers 13 and 13' are provided on the branch duct 7 on the combustion exhaust gas exit side of the scrap preheating chambers 6 and 6'. By opening one of the dampers 12 and 12' and closing the other thereof, the combustion exhaust gas is directed to only one of the two scrap preheating chambers 6 and 6' to preheat steel scrap charged in this scrap preheating chamber. It is therefore possible to prepare for the next run of preheating by charging another batch of steel scrap, which is to be preheated, into the other scrap preheating chamber.

Steel scrap usually contains entrapped oil, rubber, vinyl, plastics and other combustible substances. Therefore, when preheating steel scrap charged in a scrap preheating chamber by a high-temperature combustion exhaust gas, these combustible substances entrapped in the steel scrap burn in contact with the combustion exhaust gas under the influence of the heat thereof. This combustion, being an incomplete combustion in general, produces an incomplete-combustion gas containing hydrocarbon in the form of a white fume emitting an offensive odor and carbon monoxide. This incomplete-combustion gas, which cannot be caught by a dust collector and is therefore discharged to the open air as it is, forms a source of air pollution and this has been considered a problem impairing the environmental health.

The temperature of an exhaust gas produced in an electric furnace varies throughout the entire refining process from the beginning to the end of refining, not being kept at a constant level. However, according to the conventional method for preheating steel scrap, the exhaust gas has been fed into the scrap preheating chamber always in a constant quantity to preheat steel scrap. As a result, the steel scrap preheated in the scrap preheating chamber has varied in temperature according to the timing of production of the combustion exhaust gas in the electric furnace having preheated the steel scrap: it has sometimes been over the necessary level, or under this level in some others, being far from reaching the target preheating temperature.

When the temperature of the combustion exhaust gas directed to the scrap preheating chamber from the electric furnace through the exhaust gas combustion chamber is over the necessary level, combustion of the above-mentioned combustible substances entrapped in the steel scrap during preheating by the combustion exhaust gas becomes violent, thus causing oxidation of the steel scrap. This results in a lower steelmaking yield in the steelmaking operation in which the above-mentioned steel scrap is used as a raw material. The steel scrap, put in a prescribed basket, is charged into the scrap preheating chamber, and is preheated by the combustion exhaust gas blown into this basket. When the temperature of this combustion exhaust gas is over the necessary level, the above-mentioned basket is subjected to a thermal deformation by the high-temperature combustion exhaust gas. The steel scrap in the basket thermally expands to a larger volume under the effect of heating by the high-temperature combustion exhaust gas. As a result, the steel scrap does not smoothly drop from the basket when charging the steel scrap into the electric furnace, thus making it difficult to charge the scrap into the electric furnace. Even if the steel scrap is charged into the electric furnace, there may be the problem of the lid of the electric furnace which cannot be closed. When the temperature of the combustion exhaust gas directed to the scrap preheating chamber is low, on the other hand, it is impossible to preheat the steel scrap charged in the scrap preheating chamber to a prescribed temperature.

Under the above-mentioned circumstances, there is a strong demand for development of a method in which, in preheating steel scrap to be charged into an electric furnace by using an exhaust gas produced in the electric furnace, discharge of a white-fume-like incomplete-combustion gas emitting an offensive odor resulting from the incomplete combustion of such combustible substances as oil, rubber, vinyl and plastics entrapped in the steel scrap under the effect of the heat of the above-mentioned exhaust gas is prevented, and also preheating of the steel scrap always to a prescribed temperature is accomplished, even if the temperature of the exhaust gas for preheating the steel scrap varies. However, such a method has not as yet been proposed.

SUMMARY OF THE INVENTION

A principal object of the present invention is therefore to provide a method for preheating steel scrap, in which, in preheating the steel scrap by using an exhaust gas produced in an electric furnace, discharge of a white-fume-like incomplete-combustion gas emitting an offensive odor resulting from the incomplete combustion of such combustible substances as oil, rubber, vinyl and plastics entrapped in the steel scrap under the effect of the heat of the above-mentioned exhaust gas is prevented, and also preheating of the steel scrap to a prescribed temperature without causing a pollution problem is accomplished.

Another object of the present invention is to provide a method for preheating steel scrap, in which, in preheating the steel scrap by using an exhaust gas produced in an electric furnace, preheating of the steel scrap to a prescribed temperature irrespective of the temperature variation of the above-mentioned exhaust gas without causing a pollution problem is accomplished.

In accordance with one of the features of the present invention, there is provided:

a method for preheating steel scrap by an exhaust gas from a steelmaking electric furnace, which comprises:

selectively directing, when manufacturing steel from steel scrap in an electric furnace, an exhaust gas produced in said electric furnace to an exhaust gas combustion chamber provided in a discharge duct of said exhaust gas to cause combustion of carbon monoxide contained in said exhaust gas to form a combustion exhaust gas; and, directing part of said combustion exhaust gas into at least one scrap preheating chamber provided in a branch duct branching off from said discharge duct to preheat steel scrap charged in said scrap preheating chamber to a prescribed temperature;

said method being charactrized by:

feeding back all of said combustion exhaust gas after preheating said steel scrap charged in said scrap preheating chamber to said exhaust gas combustion chamber to cause combustion of an incomplete-combustion gas which is produced by the incomplete combustion of combustible substances entrapped in said steel scrap and which is contained in said combustion exhaust gas.

DETAILED DESCRIPTION OF PREFERRED EMBODIMENTS

Now, the method for preheating steel scrap by an exhaust gas from a steelmaking electric furnace of the present invention is described in detail by means of examples with reference to the drawings.

EXAMPLE 1

Figure 3:
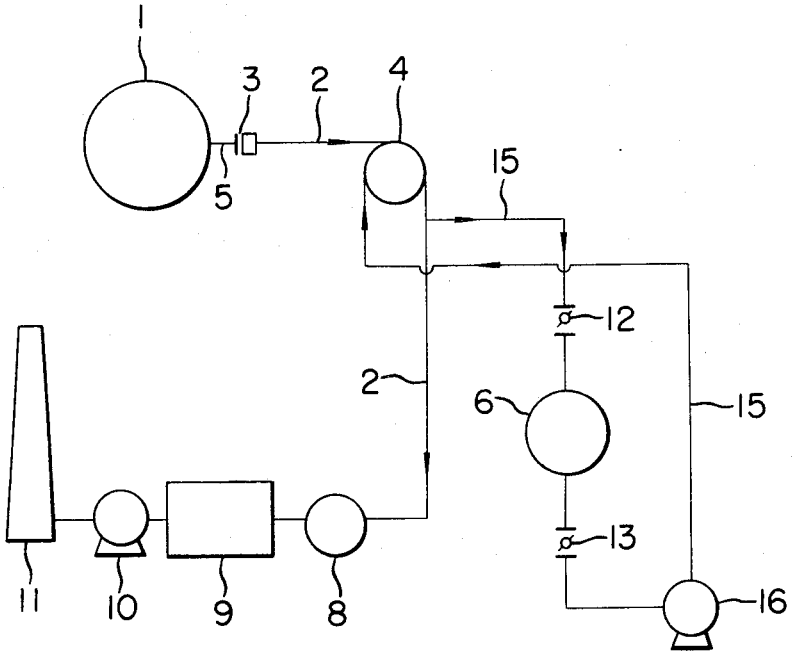
FIG. 3 is a schematic drawing illustrating an embodiment of the method of the present invention; and, FIG. 4 is a schematic drawing illustrating another embodiment of the method of the present invention.

FIG. 3 is a schematic drawing illustrating an embodiment of the method of the present invention. An exhaust gas produced in the electric furnace 1 during refining is discharged from an exhaust duct 5 provided in the lid of the electric furnace 1, directed to an exhaust gas combustion chamber 4 through a discharge duct 2 together with air in an appropriate quantity sucked from a gap 3 having an adjustable opening, and forms a combustion exhaust gas resulting from the combustion of carbon monoxide of the exhaust gas in the exhaust gas combustion chamber 4.

The above-mentioned combustion exhaust gas is discharged to the open air from a chimney 11 by means of a fan 10 provided in the middle of the discharging duct 2, through a cooling chamber 8 and a dust collector 9. A part of this combustion exhaust gas is directed to a branch duct 15 branching off from the discharge duct 2 by means of a fan 16 provided in the middle of a branch duct 15. The branch duct 15 is a duct branching off from the discharge duct 2 and coupled back to the exhaust gas combustion chamber 4. A scrap preheating chamber 6 is provided in the middle of the branch duct 15. The part of the combustion exhaust gas flowing through the branch duct 15 is therefore directed to the scrap preheating chamber 6, preheats the steel scrap, and is then fed back to the exhaust gas combustion chamber 4.

The combustion exhaust gas after preheating the steel scrap in the scrap preheating chamber 6 contains an incomplete-combustion gas formed by the incomplete combustion of such combustible substances as oil, rubber, vinyl and plastics entrapped in the steel scrap as mentioned above. This incomplete-combustion gas is burned in the exhaust gas combustion chamber 4. Namely, the combustion exhaust gas thus fed back to the exhaust gas combustion chamber 4 via branch duct 15, and in which the unburned elements of the combustion exhaust gas have been burned, is discharged again into the discharge duct 2, and then discharged to the open air from the chimney 11 through the cooling chamber 8 and the dust collector 9.

Figure 1:
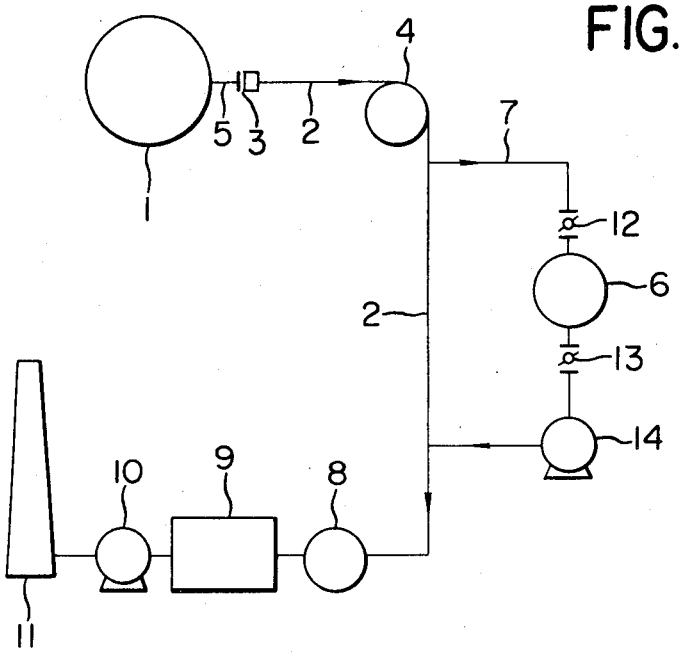
FIG. 1 is a schematic drawing illustrating an embodiment of the conventional method for preheating steel scrap.
Figure 2:
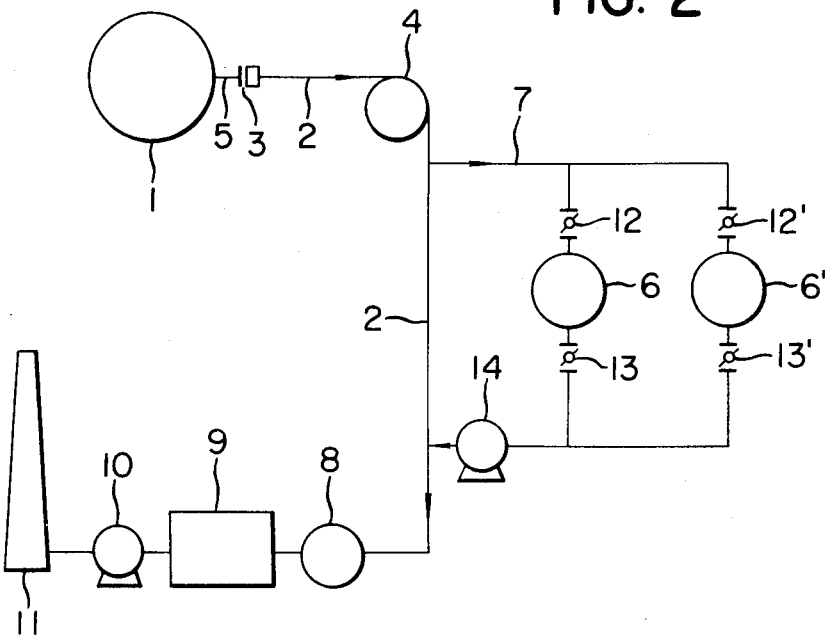
FIG. 2 is a schematic drawing illustrating another embodiment of the conventional method for preheating steel scrap.

Table 1 shows values of temperature and chemical composition of the combustion exhaust gas before and after preheating of steel scrap in the case where the steel scrap is preheated by the conventional method shown in FIG. 1. Table 2 shows values of temperature and chemical composition of the combustion exhaust gas before and after preheating of steel scrap in the case where the steel scrap is preheated by the method of the present invention shown in FIG. 3.

TABLE 1

| | Gas temp. (°C.) | Gas chemical composition (wt. %) | | | | | |
|---|---|---|---|---|---|---|---|
| | | CO | $CO_2$ | $H_2O$ | $O_2$ | $N_2$ | $C_mH_n$ |
| Exhaust gas immediately after discharged from electric furnace | 500–1500 | up to 38 | 5–30 | up to 10 | up to 15 | 60–80 | up to 2 |
| Exhaust gas in discharge duct from electric furnace to exhaust gas combustion chamber | 200–1000 | up to 12 | 2–10 | up to 5 | 13–18 | 70–80 | up to 1 |
| Combustion exhaust gas in branch duct from exhaust gas combustion chamber to scrap preheating chamber | 200–700 | 0 | up to 10 | up to 5 | 5–18 | 70–80 | 0 |
| Combustion exhaust gas in discharge duct from scrap preheating chamber to cooling chamber | 100–300 | up to 5 | up to 10 | up to 10 | up to 18 | 70–80 | up to 5 |

TABLE 2

| | Gas temp. (°C.) | Gas chemical composition (wt. %) | | | | | |
|---|---|---|---|---|---|---|---|
| | | CO | $CO_2$ | $H_2O$ | $O_2$ | $N_2$ | $C_mH_n$ |
| Exhaust gas immediately after discharged from electric furnace | 500–1500 | up to 38 | 5–30 | up to 10 | up to 15 | 60–80 | up to 2 |
| Exhaust gas in discharge duct from electric furnace to exhaust gas combustion chamber | 200–1000 | up to 12 | 2–10 | up to 5 | 13–18 | 70–80 | up to 1 |
| Combustion exhaust gas in branch duct from exhaust gas combustion chamber to scrap preheating chamber | 200–700 | 0 | up to 10 | up to 5 | 5–18 | 70–80 | 0 |
| Combustion exhaust gas in branch duct from scrap preheating chamber to exhaust gas combustion chamber | 100–300 | up to 5 | up to 10 | up to 10 | up to 18 | 70–80 | up to 5 |
| Combustion exhaust gas in discharge duct from exhaust gas combustion chamber to cooling chamber | 200–700 | 0 | up to 10 | up to 5 | 5–18 | 70–80 | 0 |

As is clear from Table 1 given above, when the steel scrap is preheated by the conventional method, the exhaust gas flowing in the discharge duct from the scrap preheating chamber to the cooling chamber after preheating of the steel scrap contains often CO and $C_mH_n$ by 5%, respectively. As is clear from Table 2 presented above, in contrast with this, when the steel scrap is preheated by the method of the present invention, the combustion exhaust gas flowing in the discharge duct from the exhaust gas combustion chamber to the cooling chamber does not contain CO and $C_mH_n$ at all. As a result, the combustion exhaust gas discharged from the chimney becomes a non-toxic gas not emitting an offensive odor nor white fumes.

In the above-mentioned embodiment, the branch duct 15 branching off from the discharge duct 2 is connected back to the exhaust gas combustion chamber 4 so that the combustion exhaust gas after preheating the steel scrap may be fed back to the exhaust gas combustion chamber 4. The branch duct 15 may also be connected back to the discharge duct 2 on the upstream side of the exhaust gas combustion chamber 4 so that the combustion exhaust gas after preheating the steel scrap may be fed back to the discharge duct 2 on the upstream side of the exhaust gas combustion chamber 4. In addition, an exhaust gas combustion chamber for burning carbon monoxide of the exhaust gas discharged from the electric furnace 1 may not specifically be provided, but a part of the discharge duct may be used as the exhaust gas combustion chamber. In this case, the combustion exhaust gas after preheating the steel scrap is fed back to a portion of the discharge duct serving substantially as the exhaust gas combustion chamber, or to the discharge duct on the upstream side of the abovementioned portion of the discharge duct.

EXAMPLE 2

Figure 4:
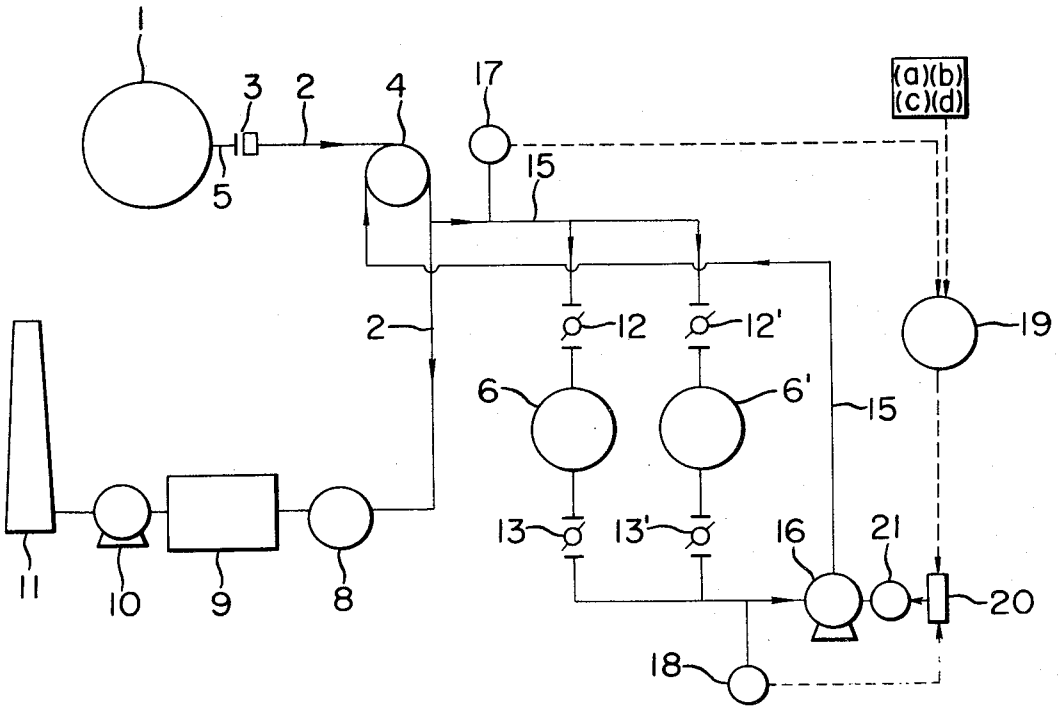

FIG. 4 is a schematic drawing illustrating another embodiment of the method of the present invention. The embodiment of Example 2 is identical with that of Example 1 in that the combustion exhaust gas after preheating the steel scrap is fed back to the exhaust gas combustion chamber 4 for burning the unburned elements of the combustion exhaust gas therein. The difference between Examples 1 and 2 is in that, in Example 2, the quantity of combustion exhaust gas directed to the scrap preheating chamber 6 or 6' is controlled according to the temperature of the combustion exhaust gas directed to the scrap preheating chamber 6 or 6' to ensure a preheating to an appropriate temperature of the steel scrap charged in the scrap preheating chamber 6 or 6' irrespective of the temperature variation of the combustion exhaust gas.

In FIG. 4, the exhaust gas produced during refining in the electric furnace 1 is discharged from an exhaust duct 5 provided in the lid of the electric furnace 1, directed to an exhaust gas combustion chamber 4 through a discharge duct 2 together with air in an appropriate quantity sucked from a gap 3 having an adjustable opening, and forms a combustion exhaust gas by causing combustion of carbon monoxide of the exhaust gas in the exhaust gas combustion chamber 4. The combustion exhaust gas is then discharged, by the action of a fan 10 provided in the middle of the discharge duct 2, to the open air from a chimney 11 through a cooling chamber 8 and a dust collector 9. A part of the combustion exhaust gas is directed to a branch duct 15 branching off from the discharge duct 2 by the action of a fan 16 provided in the middle of the branch duct 15. The branch duct 15 is a duct branching off from the discharge duct 2 and which is coupled back to the exhaust gas combustion chamber 4. Two scrap preheating chambers 6 and 6′ are provided in parallel with each other in the middle of the branch duct 15. The combustion exhaust gas flowing in the branch duct 15 is therefore directed to one of the scrap preheating chambers 6 and 6′ by operating the dampers 12 and 12′, and after preheating the steel scrap, fed back to the exhaust gas combustion chamber 4 to be discharged to the open air after combustion of its unburned elements.

In this Example 2, a thermometer 17 for continuously measuring the temperature of the combustion exhaust gas which is directed to the scrap preheating chambers 6 and 6′ is provided on the branch duct which runs to the scrap preheating chambers 6 and 6′. Another thermometer 18 for continuously measuring the temperature of the combustion exhaust gas which is discharged from the scrap preheating chambers 6 and 6′ is provided on the branch duct 15 running from the scrap preheating chambers 6 and 6′ back to the exhaust gas combustion chamber 4.

19 is a computer to which the target preheating temperature (a), the target preheating time (b), the weight (c) and the grade (d) are previously inputted regarding the steel scrap which is to be preheated in the scrap preheating chamber 6 or 6′. The temperature of the combustion exhaust gas in the branch duct 15, which is directed to the scrap preheating chambers 6 and 6′ and measured by the thermometer 17, is fed to the input of the computer 19. 20 is a controller for controlling the revolution of the motor 21 for driving the fan 16 according to the signals from the computer 19 and signals from the thermometer 18.

The temperature of the combustion exhaust gas from the exhaust gas combustion chamber 4 is continuously measured by the thermometer 17 before this combustion exhaust gas is introduced into the scrap preheating chambers 6 and 6′. The measured temperature thus obtained of the combustion exhaust gas is fed to the input of the computer 19. Then, the computer 19 calculates the quantity of the combustion exhaust gas which is to be directed to the scrap preheating chambers 6 and 6′, with the use of prescribed calculation formulae, on the basis of previously inputted parameters comprising the target preheating temperature, the target preheating time, the weight and the grade of the steel scrap which is to be preheated in the scrap preheating chambers 6 and 6′. The calculated value is fed to the controller 20 which in turn controls the revolution of the motor 21 for driving the fan 16. The quantity of the combustion exhaust gas which is to be directed to the scrap preheating chambers 6 and 6′ is thus controlled, permitting preheating of the steel scrap to a prescribed temperature in the scrap preheating chambers 6 and 6′.

Furthermore, the temperature of the combustion exhaust gas after preheating the steel scrap in the scrap preheating chambers 6 and 6′ is continuously measured by the thermometer 18, before this combustion exhaust gas is fed back to the exhaust gas combustion chamber 4. When the temperature of the combustion exhaust gas becomes a high level of over a prescribed value, a signal is issued from the thermometer 18 to the controller 20 which in turn controls the revolution of the motor 21 for driving the fan 16 in order to adjust the quantity of the combussion exhaust gas which is to be directed to the scrap preheating chambers 6 and 6′, and thereby it is accomplished to prevent the fan 16 from being damaged by the high-temperature combustion exhaust gas.

According to the above-mentioned method, it is possible to preheat the steel scrap charged in the scrap preheating chambers 6 and 6′ to a prescribed temperature in a prescribed time irrespective of the temperature variation of the combustion exhaust gas which is to be directed to the scrap preheating chambers 6 and 6′. For example, when the quantity of the combustion exhaust gas which is to be directed to the scrap preheating chambers 6 and 6′ was controlled by the above-mentioned method under the following conditions, the quantity of the combustion exhaust gas was controlled to 300 $Nm^3$/min at a combustion exhaust gas temperature of 400° C.; 270 $Nm^3$/min at 450° C., and 250 $Nm^3$/min at 500° C., thus permitting preheating of the steel scrap to a prescribed temperature in a prescribed time:

(1) Target preheating temperature of steel scrap: 200° C.
(2) Target preheating time of steel scrap: 20 minute
(3) Weight of steel scrap: 20 ton
(4) Grade of steel scrap: Heavy class Since the combustion exhaust gas circulates through the branch duct 15 which runs from the exhaust gas combustion chamber 4 to the scrap preheating chambers 6 and 6′ and returns to the exhaust gas combustion chamber 4 again according to the method of the present invention, even if the quantity variation of the combustion exhaust gas directed to the scrap preheating chambers 6 and 6′ occurred, the flow variation of the combustion exhaust gas does not occur in the discharge duct 2 which runs from the exhaust gas combustion chamber 4 to the chimney 11 through the cooling chamber 8 and the dust collector 9. The pressure-drop caused by the introduction of the combustion exhaust gas into the scrap preheating chambers 6 and 6′ exerts no effect on the dust collecting ability of the dust collector 9.

In the method of Example 2 described above, two scrap preheating chambers 6 and 6′ are provided in parallel with each other in the middle of the branch duct 15 so that the combustion exhaust gas may be introduced into one of the scrap preheating chambers 6 and 6′ by operating the dampers 12 and 12′. Or more scrap preheating chambers 6 and 6′ may however be provided in parallel with each other in the middle of the branch duct 15. When the scrap is not preheated in the methods of Examples 1 and 2, the total quantity of combustion exhaust gas may be directed to and discharged to the open air from the chimney 11 through the discharge duct 2, the cooling chamber 8 and the dust collector 9 by closing all the dampers 12 and 12′ provided on the combustion exhaust gas entry side of the scrap preheating chambers 6 and 6′.

According to the method of the present invention, as described above in detail, it is possible, in preheating steel scrap by using an exhaust gas produced during refining in an electric furnace, to prevent discharge of a white-fume-like incomplete-combustion gas emitting an offensive odor caused by the incomplete combustion of such combustible substances as oil, rubber, vinyl and plastics entrapped in the steel scrap under the effect of the heat of the exhaust gas, and to efficiently preheat the steel scrap to a prescribed temperature in a prescribed time irrespective of the temperature variation of the exhaust gas which is used to preheat the steel scrap, thus providing industrially useful effects.

What is claimed is:

1. A method of preheating steel scrap by an exhaust gas from a steelmaking electric furnace in a steelmaking system, and in which the steelmaking system comprises an electric furnace; an exhaust gas discharge duct coupled to said furnace; an exhaust gas combustion chamber coupled in said exhaust discharge duct; a branch duct branching off of said exhaust gas discharge duct downstream of said exhaust gas combustion chamber; and at least one steel scrap preheating chamber coupled in said branch duct to receive exhaust gas from said branch duct;

the method comprising:

directing, when manufacturing steel from steel scrap in said electric furnace, an exhaust gas produced in said electric furnace to said exhaust gas combustion chamber via said exhaust gas discharge duct to cause in said exhaust gas combustion chamber combustion of carbon monoxide contained in said exhaust gas to form a combustion exhaust gas;

selectively directing only part of said combustion exhaust gas from said exhaust gas combustion chamber into said at least one scrap preheating chamber via said branch duct branching off from said exhaust gas discharge duct to preheat steel scrap in said at least one scrap preheating chamber to a prescribed temperature; and feeding back all of said combustion exhaust gas from said at least one scrap preheating chamber, after said preheating of steel scrap in said at least one scrap preheating chamber, to said exhaust gas combustion chamber to cause combustion in said exhaust gas combustion chamber of an incomplete-combustion gas produced by the incomplete combustion of combustible substances entrapped in steel scrap being preheated, and which incomplete-combustion gas is contained in said combustion exhaust gas fed back from said at least one scrap preheating chamber.

2. The method of claim 1, comprising:

continuously measuring the temperature of said combustion exhaust gas from said exhaust gas combustion chamber and before introduction thereof into said at least one scrap preheating chamber; and controlling the quantity of said combustion exhaust gas which is selectively directed to said at least one scrap preheating chamber as a function of the measured temperature of said combustion exhaust gas and parameters comprising the target preheating temperature, the target preheating time, and the weight and grade of the steel scrap which is to be preheated in said at least one scrap preheating chamber, thereby preheating said steel scrap in said at least one scrap preheating chamber to a prescribed temperature.

3. The method of claim 2, comprising:

continuously measuring the temperature of the combustion exhaust gas output from said at least one scrap preheating chamber before it is fed back into said exhaust gas combustion chamber; and said controlling step controls said quantity of exhaust gas also as a function of the measured temperature thus obtained of said combustion exhaust gas output from said at least one scrap preheating chamber.

4. The method of claim 3 wherein said controlling step comprises controlling the operation of a fan in said branch duct, said fan causing movement of the combustion exhaust gas in said branch duct.

5. The method of claim 1, comprising:

continuously measuring the temperature of the combustion exhaust gas output from said at least one scrap preheating chamber before it is fed back into said exhaust gas combustion chamber; and controlling the quantity of said combustion exhaust gas which is introduced into said at least one scrap preheating chamber as a function of the measured temperature thus obtained of said combustion exhaust gas output from said at least one scrap preheating chamber.

6. The method of claim 5 wherein said controlling step comprises controlling the operation of a fan in said branch duct, said fan causing movement of the combustion exhaust gas in said branch duct.

* * * * *

UNITED STATES PATENT AND TRADEMARK OFFICE

CERTIFICATE OF CORRECTION

PATENT NO. : 4,375,958

DATED : March 8, 1983

INVENTOR(S) : Takasuburo DATE et al

It is certified that error appears in the above-identified patent and that said Letters Patent is hereby corrected as shown below:

Col. 8, line 58, "or more" should read --Three or more --.

Signed and Sealed this

*Thirty-first* Day of *May 1983*

[SEAL]

*Attest:*

DONALD J. QUIGG

*Attesting Officer*

*Acting Commissioner of Patents and Trademarks*